US006901875B1

(12) United States Patent
Beal et al.

(10) Patent No.: US 6,901,875 B1
(45) Date of Patent: Jun. 7, 2005

(54) RETRACTABLE MARINE FITTING

(75) Inventors: Robert Wayne Beal, Tualatin, OR (US); Thomas J Vincent, Grants Pass, OR (US)

(73) Assignee: Oregon Iron Works, Inc., Clackamas, OR (US)

( * ) Notice: Subject to any disclaimer, the term of this patent is extended or adjusted under 35 U.S.C. 154(b) by 0 days.

(21) Appl. No.: 10/844,848

(22) Filed: May 12, 2004

(51) Int. Cl.[7] ..... B63B 21/04
(52) U.S. Cl. ..... 114/218; 410/107
(58) Field of Search ..... 114/218; 410/107–111

(56) References Cited

U.S. PATENT DOCUMENTS 5,106,248 A * 4/1992 Harris ..... 410/107
5,301,627 A * 4/1994 Czipri ..... 114/218
5,983,820 A * 11/1999 Whitley ..... 114/218

* cited by examiner

*Primary Examiner*—Jesus D. Sotelo
(74) *Attorney, Agent, or Firm*—Ingrid McTaggart

(57) ABSTRACT

One embodiment of a retractable marine fitting includes a housing positioned within a marine hull, the housing adapted to receive a fitting therein, and a fitting including an elongate body movable between an extended position substantially outwardly of the housing and a retracted position substantially inwardly of the housing.

33 Claims, 4 Drawing Sheets

RETRACTABLE MARINE FITTING

BACKGROUND

Marine vessels may include fittings that may be accessed outside the vessel's hull while the vessel is stationary or during times of relatively slow movement. Such fittings may include a tow fitting. However, it may be desirable that the vessel's hull be streamlined for efficiency during relatively fast movement of the vessel.

DETAILED DESCRIPTION OF THE DRAWINGS

Figure 1:
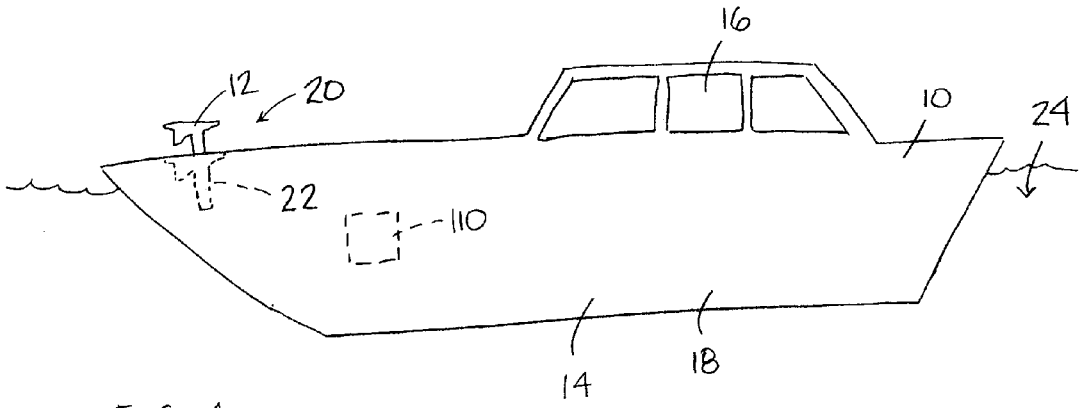
FIG. 1 is a perspective view of one embodiment of a marine vessel including one embodiment of a retractable marine fitting in an extended position.

FIG. 1 is a perspective view of one embodiment of a marine vessel 10 including one embodiment of a retractable marine fitting 12 in an extended position. Fitting 12 may comprise a tow fitting, a hand rail, a tie-down cleat, a periscope, a wind measurement device, a navigational device, a communication device, or a mooring device. Vessel 10 may comprise any vessel adapted for use on or in water, such as a boat, a submarine, or a plane adapted for landing on water. In the embodiment shown, vessel 10 may comprises a boat. Vessel 10 may include a hull 14 and a control area 16 for crew members. Hull 14 may include an exterior surface 18 that may be generally streamlined and/or have a smooth surface so as to cut through the water during movement of vessel 10 therethrough. Fitting 12 may be moved from an extended position 20 into a retracted position 22 (shown in dash lines) within hull 14 so that hull 14 may have a substantially streamlined and smooth exterior surface 18 during movement of hull 14 through air and/or a body of water 24.

Figure 2:
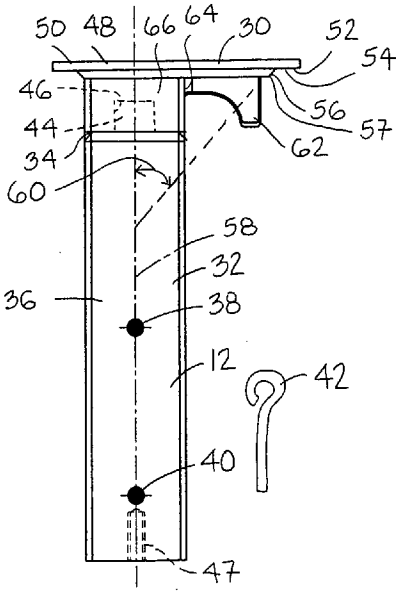
FIG. 2 is a side view of one embodiment of a marine fitting.

FIG. 2 is a side view of one embodiment of marine fitting 12. Fitting 12 may include an upper region 30 and a lower region 32 which may be secured together by a weld 34. Lower region 32 may comprises a substantially solid, elongate member 36 which may include first and second bore holes 38 and 40, respectively, therethrough. First bore hole 38 may be adapted for receiving a securing device, such as a pin 42, therethrough so as to retain fitting 12 in a stowed or retracted position 22 (see FIG. 1) and second bore hole 40 may be adapted for receiving pin 42 therethrough so as to retain fitting 12 in an extended or in-use position 20 (see FIG. 1). Lower region 32 may comprise a protrusion, such as a cylindrical shaped tab 44 adapted for being received within a mating recess, such as a cylindrically shaped recess 46 in upper region 30 of fitting 12. A lower portion of lower region 32 may comprise a recess 47 that may be adapted to receive a protrusion (not shown) therein, such as when fitting 12 is in a lowered or retracted position 22 within hull 14 (see FIG. 1). Accordingly, recess 47 may be utilized to align fitting 12 into a predetermined position during retraction thereof.

Upper region 30 may comprise a top plate 48 that may define a substantially flat and smooth top surface 50 and a lower surface 52 that may define an outer region 54 and a ramped region 56. Outer region 54 may be positioned substantially perpendicular to an elongate axis 58 of fitting 12 and ramped region 56 may be positioned at an acute angle 60 with respect to elongate axis 58. Outer region 54 may extend substantially completely around lower surface 52 of top plate 48 and may be adapted for contacting a seal of a housing (see FIG. 4) adapted for receiving fitting 12 therein. Ramped region 56 may also extend substantially completely around lower surface 52 of top plate 48 and may define a ramped surface 57 that may define an angle 60 in a range of greater than zero to less than ninety degrees, and, in the embodiment shown, may comprise an angle 60 of approximately forty five degrees. Ramped surface 57, also referred to as a shoulder, may be adapted for mating with a mating ramped surface of a housing (see FIG. 4) so as to position fitting 12 in a predetermined aligned position within hull 14 (see FIG. 1) when the fitting is retracted therein.

Upper region 30 may further comprise a hook 62 extending downwardly from top plate 48 so as to allow securement of a tow line (not shown) to fitting 12. Hook 62 may be positioned radially inwardly of shoulder 57. Accordingly, in the embodiment shown, marine fitting 12 may comprise a tow fitting adapted to facilitate towing of vessel 10 (see FIG. 1). Upper region 30 may further comprise transition structures 64 that may function to transition hook 62 to a base section 66 of upper region 30 so as to reduce point loading within fitting 12.

Figure 3:
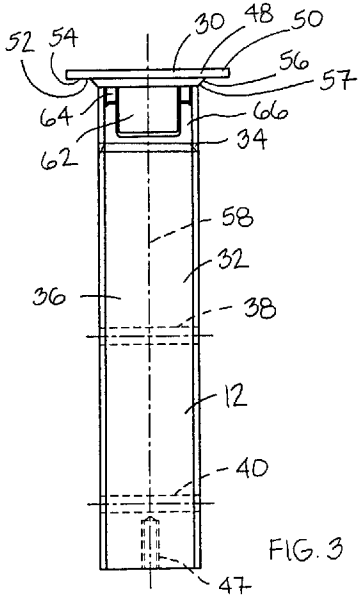
FIG. 3 is a front view of the marine fitting of FIG. 2.

FIG. 3 is a front view of marine fitting 12 of FIG. 3 showing outer region 54 and ramped region 56 extending substantially around lower surface 52 of top plate 48.

Figure 4:
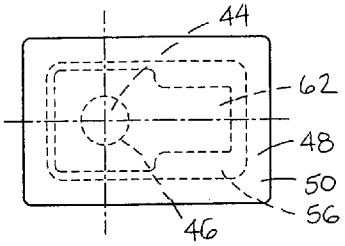
FIG. 4 is a top view of the marine fitting of FIG. 2.

FIG. 4 is a top view of marine fitting 12 of FIG. 3 showing top surface 50 of top plate 48. In the embodiment shown, top surface 50 has a generally rectangular shape. However, any shape as may be desirable for a particular application may be utilized.

Figure 5:
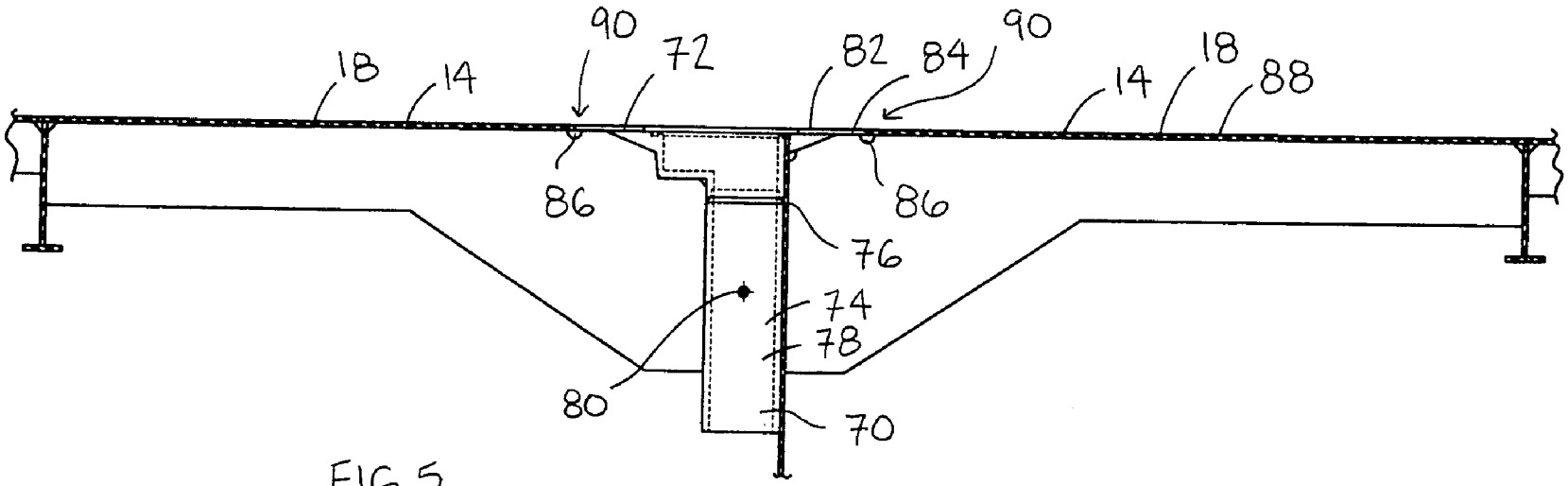
FIG. 5 is a side view of one embodiment of a housing for one embodiment of a marine fitting.

FIG. 5 is a side view of one embodiment of a housing 70 for one embodiment of a marine fitting 12 (see FIG. 2). Housing 70 may include an upper region 72 and a lower region 74 which may be secured to one another by a weld 76. Lower region 74 may include an elongate member 78 and a bore hole 80 extending therethrough for receiving pin 42 (see FIG. 2) therethrough. Upper region 72 may include a top plate 82 having a top surface 84 that may be welded to hull 14 by a weld 86. In the embodiment shown, top surface 84 of top plate 82 and exterior surface 18 of hull 14 may define a single plane 88 (shown in end view) such that an interface 90 between hull 14 and top plate 82 may define a smooth surface. Upper region 72 may be sized to receive upper region 30 of fitting 12, including hook 62. Bore hole 80 may be positioned in lower region 74 of housing 70 so as be aligned with first bore hole 38 of fitting 12 when fitting 12 is in a retracted position 22 (see FIG. 1), and bore hole 80 may be aligned with second bore hole 40 of fitting 12 when fitting 12 is in an extended position 20 (see FIG. 1).

Figure 6:
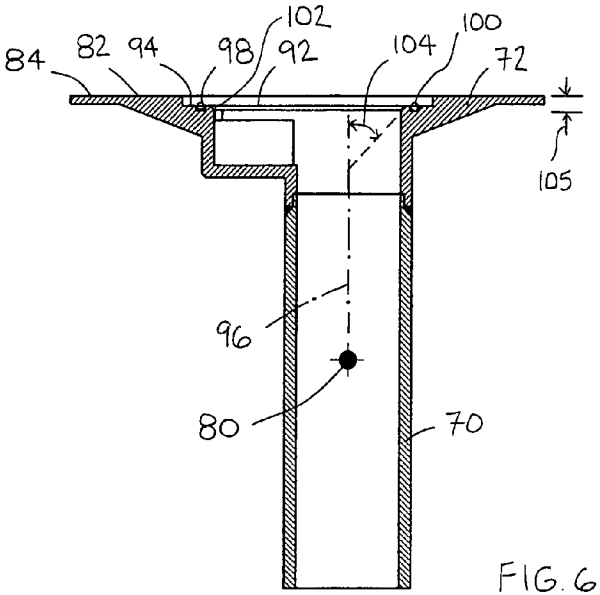
FIG. 6 is a side, cross-sectional view of the housing of FIG. 5.

FIG. 6 is a side, cross-sectional view of housing 70 of FIG. 5. Upper region 72 of housing 70 may include a recess 92 that may define a surface 94 positioned substantially perpendicular to an elongate axis 96 of housing 70. Surface 94 may include a recess 98 therein sized to received a seal, such as an elastomeric o-ring 100, therein. Recess 92 may be sized to receive top plate 48 of fitting 12 (see FIG. 2) such that lower surface 52 of top plate 48 may be positioned adjacent surface 94 of recess 92 and such that seal 100 may define a water tight seal between surface 94 of housing 70 and surface 52 of fitting 12. Formation of a water-tight seal between fitting 12 and housing 70 may allow hull 14 to retain air therein so as to define a buoyancy effect in the hull, and may allow hull 14 to retain water therein so as to allow vessel 10 to be at least partially submerged under a body of water 24. In the embodiment shown, recess 98 and seal 100 therein may each extend substantially completely around recess 92 such that in retracted position 22 (see FIG. 2), fitting 12 may be sealingly received within housing 70.

Upper region 72 of housing 70 may further include a ramped surface 102 that may define an angle 104 with elongate axis 96, wherein angle 104 may be in a range of greater than zero degrees and less than ninety degrees. In the embodiment shown, ramped surface 102 may be inclined with respect to elongate axis 96 at an angle substantially similar to the angle of inclination of angle 60 (see FIG. 2) of fitting 12, such as an angle of forty five degrees. Ramped surface 102 of housing 70 may be inclined, and may be positioned a vertical distance 105 below top surface 84 of housing 70, so as to receive ramped surface 57 of fitting 12 in a predetermined orientation so as to align fitting 12 in a unique position within housing 70 when fitting 12 is retracted therein. In other words, ramped surfaces 102 and 57 may define a depth control device to control the position of top surface 50 of fitting 12 with respect to top surface 84 of housing 70. In the embodiment shown, each of ramped surfaces 102 and 57 have a substantially rectangular perimeter. However, any shape may be utilized as is desired for a particular application. Ramped surface 102 of housing 70 may also be positioned so as to abut ramped surface 57 of fitting 12 completely along the ramped surfaces such that fitting 12 is electrically connected to housing 70. In other words, fitting 12 and housing 70 may both be manufactured to electrically conductive material and may define a smooth electrical conductivity path when ramped surface 102 of housing 70 receives ramped surface 57 of fitting 12 thereagainst. Furthermore, ramped surface 102 of housing 70 may be positioned so as to abut ramped surface 57 of fitting 12 completely along the ramped surfaces such that fitting 12 is aligned by housing 70 in a single, predetermined orientation when fitting 12 is retracted within housing 70.

Figure 7:
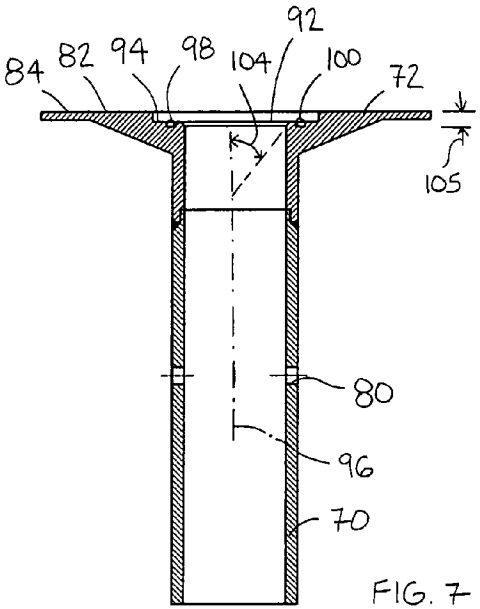
FIG. 7 is a front, cross-sectional view of the housing of FIG. 5.

FIG. 7 is a front, cross-sectional view of housing 70 of FIG. 5.

Figure 8:
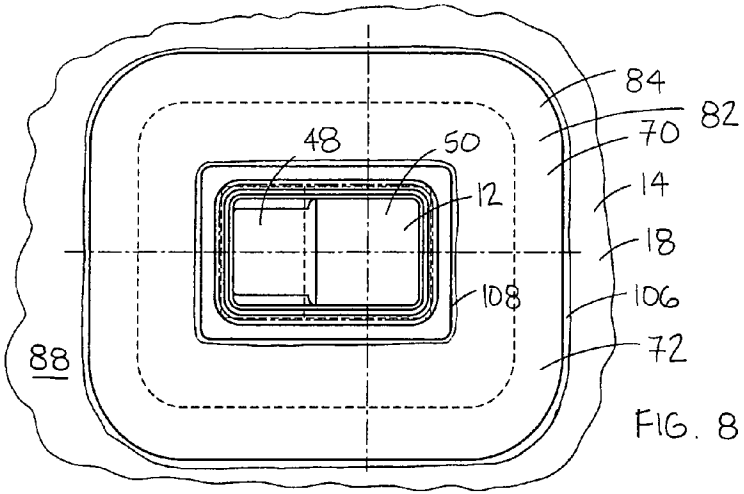
FIG. 8 is a top view of one embodiment of a marine hull, a housing secured thereto, and with one embodiment of a fitting positioned therein.

FIG. 8 is a top view of one embodiment of a marine hull 14, a housing 70 secured thereto, and with one embodiment of a fitting 12 positioned therein. In the embodiment shown, exterior surface 18 of hull 14, top surface 84 of housing 70 and top surface 50 of fitting 12 are each substantially positioned in plane 88 when fitting 12 is in the retracted position 22 (see FIG. 1) within housing 70. In other words, exterior surface 18 of hull 14, top surface 84 of housing 70 and top surface 50 of fitting 12 may each define a plane that is positioned substantially parallel to, and generally within approximately 0.25 inches (in), and more particularly within approximately 0.030 in or less, from plane 88 such that there is no substantial vertical step, i.e., a vertical discontinuity, between the hull, the housing and the fitting. Moreover, a gap 106, i.e., a horizontal discontinuity, between housing 70 and hull 14 may be substantially small, such as approximately 0.25 in, and more particularly approximately 0.030 in or less, and a gap 108 between top plate 48 of fitting 12 and top plate 82 of housing 70 may be substantially small, such as approximately 0.25 in, and more particularly approximately 0.050 in or less. Due to the positioning of the exterior surfaces of hull 14 and top plates 84 and 50 substantially in single plane 88, and due to the relatively small size of gaps 106 and 108, marine vessel 10 may have a reduced susceptibility to radar detection. In other words, retractable fitting 12 may maintain the radar signature boundaries of marine vessel 10. Stated yet another way, retractable fitting 12 may maintain the vertical steps and the horizontal gaps within hull 14 so as to reduce detection of vessel 10 by radar. Moreover, the smooth exterior surface of the vessel hull, housing and fitting may reduce drag of the vessel during motion of the vessel through air or a body of water.

In the embodiment shown, fitting 12, housing 70, hull 14 and weld 86 (see FIG. 5) may each be manufactured of a conductive material such as metal, namely aluminum. Accordingly, through weld 86, housing 70 and hull 14 may be in electrical contact with one another. Through ramped surfaces 57 and 102, fitting 12 and housing 70 may be in electrical contact with one another. Stated another way, hull 14 and housing 70 may define a continuous path of conductivity, and fitting 12 and housing 70 define a continuous path of conductivity. Due to the smooth conductive transition from hull 14 to housing 70 to fitting 12, marine vessel 10 may have a reduced susceptibility to radar detection.

Referring again to FIGS. 2 and 5, pin 42 may be placed through bore hole 80 of housing 70, and through either of bore holes 38 or 49 of fitting 12, manually or automatically, such as by a motor 110 (shown schematically in FIG. 1). Moreover, fitting 12 may be raised or lowered manually or automatically such as by motor 110.

Other variations and modifications of the concepts described herein may be utilized and fall within the scope of the claims below.

We claim:

1. A retractable marine fitting, comprising:

a housing positioned within a marine hull, said housing adapted to receive a fitting therein; and a fitting including an elongate body movable between an extended position substantially outwardly of said housing and a retracted position substantially inwardly of said housing, wherein said housing includes a top plate secured to said hull to define a water-tight seal therebetween, and said marine fitting further comprising a seal that contacts said housing and said fitting in said retracted position so as to define a water-tight seal therebetween.

2. A fitting according to claim 1 wherein said housing defines a top surface and said fitting defines a top surface, and wherein in said retracted position, said housing top surface and said fitting top surface are positioned substantially in a single plane.

3. A fitting according to claim 1 wherein in said retracted position said housing and said fitting are in electrical connection with one another.

4. A fitting according to claim 1 further comprising an elastomeric seal positioned within said housing, said seal positioned within said housing so as to contact said fitting in said retracted position so as to define a water-tight seal between said housing and said fitting in said retracted position.

5. A fitting according to claim 1 wherein said housing includes a tapered surface and said fitting includes a mating tapered surface, and wherein said tapered surface and said mating tapered surface are in contact with one another in said retracted position, and wherein said contact provides an electrical connection between said housing and said fitting in said retracted position.

6. A fitting according to claim 1 wherein said housing includes a tapered surface and said fitting includes a mating tapered surface, and wherein said tapered surface and said mating tapered surface are in contact with one another in said retracted position so as to vertically align said fitting within said housing in said retracted position.

7. A fitting according to claim 1 wherein said housing includes a tapered surface and said fitting includes a mating tapered surface, and wherein said tapered surface and said mating tapered surface are in contact with one another in said retracted position so as to horizontally align said fitting within said housing in said retracted position.

8. A fitting according to claim 1 wherein said fitting is chosen from one of a tow fitting, a hand rail, a tie-down cleat, a periscope, a wind measurement device, a navigational device, a communication device, and a mooring device.

9. A fitting according to claim 1 wherein said housing is positioned in a marine hull chosen from one of a boat, a submarine, and a plane that can land on water.

10. A fitting according to claim 1 further comprising a manual extension device for moving said fitting between said extended and retracted positions.

11. A fitting according to claim 1 further comprising an automatic extension device for moving said fitting between said extended and retracted positions.

12. A fitting according to claim 1 further comprising a locking device adapted to lock said fitting in said retraction position.

13. A fitting according to claim 1 further comprising a locking device adapted to lock said fitting in said extended position.

14. A marine vessel, comprising:

a hull;

a housing secured to said hull; and a fitting operatively connected to said housing, said fitting adapted to move between an extended position at least partially outwardly of said housing and a stowed position at least partially inwardly of said housing, wherein said housing includes a recess that defines a shoulder positioned substantially perpendicular to an elongate axis of said housing, said shoulder including a recess for receiving a seal that defines a water-tight barrier between said housing and said fitting in said stowed position.

15. A marine vessel according to claim 14 wherein said housing includes a top plate secured to said hull to define a water-tight seal therebetween, and said marine vessel further comprising a seal that contacts said housing and said fitting in said stowed position so as to define a water-tight seal therebetween.

16. A marine vessel according to claim 14 wherein said housing includes a shoulder positioned at an acute angle with respect to an elongate axis of said housing, and wherein said fitting includes a shoulder positioned at an acute angle with respect to said elongate axis of said housing, wherein said shoulder of said housing is in mating contact with said shoulder of said fitting in said stowed position so as to define a unique position of said fitting in said stowed position.

17. A marine vessel according to claim 16 wherein said shoulder of said housing and said shoulder of said fitting each define a substantially rectangular perimeter.

18. A marine vessel according to claim 16 wherein said unique position of said fitting in said stowed position defines a smooth outer surface of said hull, said housing and said fitting.

19. A marine vessel according to claim 16 wherein said hull, said housing and said fitting are manufactured of a conductive material, and said mating contact between said housing and said fitting in said stowed position provides an electrical conductivity between said housing and said fitting in said stowed position.

20. A marine vessel according to claim 16 wherein said fitting comprises a tow fitting including a downwardly extending hook positioned radially inwardly of said fitting shoulder.

21. A marine vessel according to claim 16 further comprising a seal secured on said housing radially outwardly of said housing shoulder and contacting said fitting in said stowed position so as to define a water-tight seal between said housing and said fitting in said stowed position.

22. A marine vessel according to claim 14 wherein said housing defines an elongate lower portion including an elongate axis and an aperture extending therethrough and perpendicularly to said elongate axis, and wherein said fitting defines an elongate lower portion including an elongate axis and first and second apertures extending therethrough and perpendicularly to said elongate axis, wherein said first aperture of said fitting is aligned with said aperture of said housing in said extended position and wherein said second aperture of said fitting is aligned with said aperture of said housing in said stowed position.

23. A method of retracting a marine extension device, comprising:

moving a marine extension device from an extended position substantially outside a marine hull to a retracted position substantially inside a marine hull, wherein a tapered surface of said extension device is moved into said hull during said moving;

engaging said tapered surface of said extension device with a tapered surface of said marine hull, wherein said engagement guides said extension device into a unique predetermined position within said hull so as to provide a smooth radar signature of said hull and said extension device in said retracted position; and engaging a shoulder of said extension device with a seal of said housing so as to define a water-tight connection between said extension device and said housing in said retracted position.

24. A method according to claim 23 further comprising:

securing said extension device in said retracted position with a securing device.

25. A method according to claim 23 further comprising:

engaging a shoulder of said extension device with a shoulder receiving surface of said marine hull so as to provide an electrically conductive connection between said extension device and said marine hull in said retracted position.

26. A retractable marine tow fitting, comprising:

means for attaching a tow line to a marine vessel, said means for attaching movable between a tow position and a retracted position; and means for receiving said means for attaching in said retracted position so as to define a water-tight connection between said means for attaching and said means for receiving in said retracted position, wherein said means for attaching comprises an elongate stem having a downwardly extending hook on an end thereof, and wherein said means for receiving defines a housing including a first recessed region for receiving said downwardly extending hook and a second recessed region for receiving said elongate stem.

27. A tow fitting according to claim 26 wherein said means for receiving defines a unique position of said means for attaching in said retracted position.

28. A tow fitting according to claim 26 wherein said means for receiving provides electrical conductivity to said means for attaching in said retracted position.

29. A marine vessel comprising:

a marine hull including an outer plate that defines an outer surface;

a housing including a top plate that defines a housing top surface, a housing elongate axis extending substantially perpendicular to said top surface, a recessed shoulder positioned substantially parallel to said top surface and including a seal positioned thereon, a housing tapered shoulder inclined with respect to said housing top surface and positioned inwardly of said recessed shoulder, an elongate recess positioned inwardly of said tapered shoulder and adapted for receiving an elongate portion of a fitting therein, and wherein said housing is secured to said marine hull such that said hull outer surface and said housing top surface are both positioned in a single plane; and a fitting movable between an extended position and a stowed position, said fitting including an elongate portion that defines a fitting elongate axis, a hook secured to said elongate portion and a fitting top plate secured to said hook and that defines a fitting top surface and a lower surface each positioned substantially perpendicular to said fitting elongate axis, said fitting top surface positioned in said single plane and said lower surface contacting said seal when said fitting is in said stowed position, said fitting further including a fitting tapered surface that is aligned by said housing tapered shoulder so as to define a single orientation of said fitting in said stowed position.

30. An extendable marine apparatus, comprising:

a receptacle positioned within a marine hull, said receptacle adapted to receive a marine fitting therein; and a marine fitting including a top portion movable between an extended position outwardly of said housing and a retracted position inwardly of said housing, wherein said top portion of said marine fitting includes a top plate that sealing engages said receptacle in said retracted position.

31. A marine apparatus according to claim 30 wherein said top portion of said marine fitting includes a tapered surface that matingly engages said receptacle in said retracted position so as to align said marine fitting in a unique position within said receptacle in said retracted position.

32. A marine apparatus according to claim 30 wherein said top portion of said marine fitting includes a tapered surface that matingly engages said receptacle in said retracted position so as to define an electrical conductivity path between said housing said marine fitting in said retracted position.

33. A marine apparatus according to claim 30 wherein said top portion of said marine fitting includes a device chosen from one of a tow connection hook, a hand rail, a tie-down cleat, a periscope, a wind measurement device, a navigational device, a communication device, and a mooring device.

* * * * *